US007654299B2

(12) United States Patent
LeBlanc et al.

(10) Patent No.: US 7,654,299 B2
(45) Date of Patent: Feb. 2, 2010

(54) WINDOW SHADE LINER METHOD AND APPARATUS

(75) Inventors: Robert S. LeBlanc, Powder Springs, GA (US); James J. Hyman, Carson, CA (US)

(73) Assignee: Lewis Hyman Inc., Carson, CA (US)

( * ) Notice: Subject to any disclaimer, the term of this patent is extended or adjusted under 35 U.S.C. 154(b) by 310 days.

(21) Appl. No.: 11/208,008

(22) Filed: Aug. 22, 2005

(65) Prior Publication Data

US 2006/0060308 A1 Mar. 23, 2006

Related U.S. Application Data

(60) Provisional application No. 60/602,882, filed on Aug. 20, 2004.

(51) Int. Cl.
*A47H 5/00* (2006.01)
*E06B 3/80* (2006.01)

(52) U.S. Cl. ..... 160/84.01; 160/179

(58) Field of Classification Search ..... 160/84.01, 160/89, 126, 179
See application file for complete search history.

(56) References Cited

U.S. PATENT DOCUMENTS

| | | | | | |
|---|---|---|---|---|---|
| 1,778,499 | A | | 10/1930 | King | |
| 2,252,070 | A | * | 8/1941 | Roger | 160/386 |
| 2,288,397 | A | * | 6/1942 | French | 139/387 A |
| 2,518,301 | A | * | 8/1950 | French et al. | 139/387 A |
| 3,777,800 | A | * | 12/1973 | Susoev | 160/84.04 |
| 5,090,466 | A | * | 2/1992 | Hong | 160/84.04 |
| 5,566,734 | A | | 10/1996 | Levy et al. | |
| 5,566,735 | A | * | 10/1996 | Jelic | 160/84.04 |
| 5,690,156 | A | * | 11/1997 | Ruggles | 160/84.04 |
| 5,787,951 | A | * | 8/1998 | Tonomura et al. | 160/84.01 |
| 5,845,690 | A | * | 12/1998 | Colson et al. | 160/84.01 |
| 5,862,850 | A | * | 1/1999 | Yang | 160/84.04 |
| 6,257,300 | B1 | * | 7/2001 | Brownlie | 160/84.01 |
| 6,497,264 | B1 | * | 12/2002 | Paskevicius | 160/84.04 |
| 6,520,238 | B2 | * | 2/2003 | Allsopp | 160/84.04 |
| 6,662,845 | B1 | * | 12/2003 | Palmer | 160/84.01 |
| 6,792,994 | B2 | * | 9/2004 | Lin | 160/84.03 |
| 6,923,236 | B2 | * | 8/2005 | Lin | 160/84.01 |
| 6,988,526 | B2 | * | 1/2006 | Judkins | 160/84.01 |
| 2004/0099381 | A1 | * | 5/2004 | Lin | 160/84.04 |
| 2004/0108078 | A1 | * | 6/2004 | Chen et al. | 160/84.01 |
| 2004/0118527 | A1 | * | 6/2004 | Lin | 160/84.04 |
| 2004/0216851 | A1 | * | 11/2004 | Yu et al. | 160/84.04 |

(Continued)

*Primary Examiner*—Katherine W Mitchell
*Assistant Examiner*—Jaime F Cardenas-Garcia
(74) *Attorney, Agent, or Firm*—Jones Day

(57) ABSTRACT

A universal removable liner attaches to a Roman shade to block sunlight and provide privacy. The shade retraction mechanism draws the shade up in tiers with one or more lift cords. The liner links to the shade across the top of the shade and at the lift cords, with the tiers formed in the shade lifting the liner in tiers as well. Links between the lift cords and the liner at the shade tier tops are closable loops. A hook-and-loop tape is preattached to the top edge of the liner, while a separate strip of adhesive-backed, mating hook-and-loop tape is furnished for user attachment to the top edge of substantially any tier-lift shade. Once the user joins the shade and liner at the tier tops, the liner forms tiers mirroring the tiers of the shade as the two are raised together.

4 Claims, 7 Drawing Sheets

U.S. PATENT DOCUMENTS

2004/0231802 A1* 11/2004 Hsu ..... 160/84.04
2004/0231804 A1* 11/2004 Ward et al. ..... 160/89
2004/0231805 A1* 11/2004 Sudano ..... 160/89
2005/0115683 A1* 6/2005 Ng et al. ..... 160/84.04
2005/0155722 A1* 7/2005 Colson et al. ..... 160/89
2005/0205217 A1* 9/2005 Harper et al. ..... 160/89
2006/0081341 A1* 4/2006 Nien et al. ..... 160/84.04
2006/0157204 A1* 7/2006 Lin ..... 160/84.04
2006/0225845 A1* 10/2006 Marusak et al. ..... 160/126
2006/0225846 A1* 10/2006 Marusak et al. ..... 160/126
2007/0246170 A1* 10/2007 Marzilli ..... 160/89

* cited by examiner

WINDOW SHADE LINER METHOD AND APPARATUS

CROSS-REFERENCE TO RELATED APPLICATIONS

This application claims priority to provisional U.S. patent application entitled, REMOVABLE LINER APPARATUS AND METHOD, filed Aug. 20, 2004, having a Ser. No. 60/602,882, the disclosure of which is hereby incorporated by reference in its entirety.

FIELD OF THE INVENTION

The present invention relates generally to window shades. More particularly, the present invention relates to an apparatus and method for providing a light blocking and visually obstructing barrier for a window shade otherwise using an admissive material.

BACKGROUND OF THE INVENTION

Functions including provision of visual barriers, physical separation, privacy, protection from strong sunlight, and decoration have been realized with curtain materials for many centuries. Apparatus realizing these purposes has been known variously by terms such as curtains, drapes, blinds, and shades, and has been implemented in numerous configurations to combine functions and provide desired appearance. An enduring style, the so-called Roman shade, uses a fabric that can be drawn away from a window, for example, commonly using two or more cords to lift the fabric, and forming the lifted fabric into tiers—that is, continuous panels extending the width of the shade, with a portion such as a bottom edge of each tier commonly visible after the Roman shade is lifted.

The fabric forming a Roman shade is preferably readily flexed or articulated to form the tiers, and is preferably caused to be somewhat rigid at least in part along each tier. In some embodiments, it is known to use small, comparatively resilient strakes, that is, pieces of materials such as reeds, split bamboo, dowels, or modern substitutes, which may be hollow or solid plastic elements such as extruded rods or tubes, to form the horizontal elements of the tiered fabric. In such embodiments, the strakes may be held together in parallel to form a surface using flexible materials such as natural or synthetic fiber threads woven around the strakes. These embodiments may be termed non-isotropic, since bending properties are necessarily different along the axes parallel to and at right angles to the strakes. In other embodiments, a substantially isotropic shade fabric may be reinforced at the locations forming the top edges of the tiers using battens, that is, relatively rigid slats or rods extending roughly the width of the shade and fastened to the shade fabric by a method such as inserting the battens into pockets formed into the fabric.

Fabrics of the types described may block most sunlight, may be highly decorative and/or durable, and may function as somewhat effective visual screens. However, in many instances, the fabrics allow some direct passage of sunlight and allow items on one side of the shade to be viewed from the other side. Some fabrics may likewise be susceptible to deterioration such as weakening or embrittlement of fibers or fading of colors caused by exposure to light. These characteristics may be undesirable in at least some applications.

A second layer of fabric, termed a liner, is sometimes added to a Roman shade to address at least some of the needs described. Liners according to known practices are customfitted to a specific size and design of shade, with attachment between the layers developed ad-hoc and frequently requiring cutting and sewing merely to remove the liner for washing, for example.

Accordingly, there is a need in the art for a second layer of fabric in the form of a liner for a Roman shade, removably attached to the shade, to increase blockage of view and blockage of solar irradiance when compared to conventional designs, while retaining utility largely equivalent to that of a Roman shade of conventional design. The need extends to a universal liner—that is, one readily attached to and removed from any available Roman shade of comparable size without experimentation or adaptation.

SUMMARY OF THE INVENTION

The foregoing needs are met, to a great extent, by the present invention, wherein an apparatus is provided that in some embodiments provides a liner attached at the top of a Roman shade and further attached to the fabric of the shade at multiple, distributed points over the surface of the shade. The use of multiple attachment points allows the liner to assume, during raising, the tiered form of the shade. The liner may blouse away from the tiers of the shade during raising, while generally mirroring the shape of the shade at successive stages of raising. For the portion of the shade that is raised, the liner moves generally in concert with the shade. The use of comparatively loose linkages between liner and shade allows the two layers to hang largely free of and parallel to each other for such portion of the shade as is not raised. The use of readily attached and/or disconnected linkages at the attachment points allows the shade and liner to be vended and maintained as independent commodities, including allowing the liner to be attached and detached by an end user, such as, for example, for washing. The use of linkages that can be positioned at a range of locations laterally across the surface of a liner permits the liner to be used with shades of varying construction details.

In accordance with one embodiment of the present invention, a window shade liner for use with a window shade having a surface, wherein the window shade surface has a first edge, wherein the window shade surface further has a second edge distal to and substantially parallel to the first edge, wherein the second edge is configured to retract and extend between an extended position and a retracted position with respect to the first edge, wherein the window shade has a retraction mechanism configured to apply a retraction motion to the shade, is presented. The window shade liner includes a window shade liner fabric layer substantially coextensive with a window shade, wherein a liner surface faces and is substantially parallel to a shade surface when the shade is in the extended position thereof, and a distributed linkage apparatus, wherein the shade and the liner are removably coupled at a plurality of substantially proximal locations on the surfaces thereof.

In accordance with another embodiment of the present invention, a method for providing a co-retractable liner to a retractable window shadeis presented. The method includes configuring a liner having a shade-facing surface to form a panel substantially parallel to and substantially coextensive with a panel formed by the shade surface when the shade is in the extended position thereof, removably linking the shade and liner at a plurality of locations on facing surfaces thereof, and establishing functionally mirrored orientations for the facing surfaces of the shade and the liner in at least the extended and retracted positions thereof.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
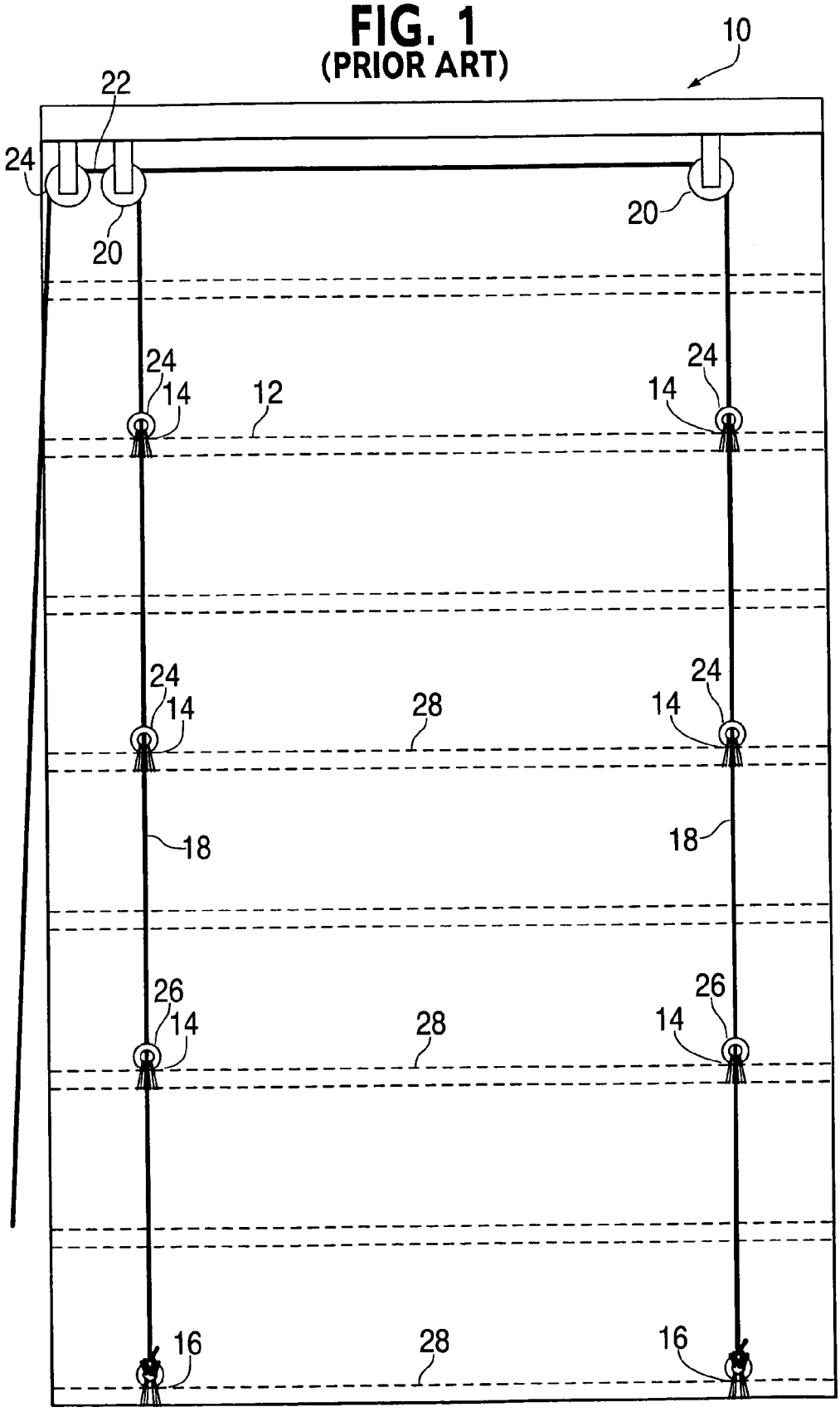
FIG. 1 (PRIOR ART)
FIG. 1 is a view, from a side away from a room, of a prior art Roman shade capable of being adapted to use the inventive apparatus.

The invention will now be described with reference to the drawing figures, in which like reference numerals refer to like parts throughout. The present invention provides an apparatus and method that in some embodiments provides a Roman shade and liner linked together in normal use, draping substantially independently when fully extended, raised together in mirrored tiers, and attached and/or detached readily, either with or without tools, sewing, or the like.

FIG. 1 illustrates a prior art Roman shade 10, viewed from the outdoor-facing side, that can be adapted to accept the inventive apparatus. Tier structure 12 provides a plurality of lift points 14 and 16, while cords 18 drawn upward use pulleys 20 in the embodiment shown to direct the cords 18 to a common gathering point 22. As preferred in an embodiment, one of the pulleys 20, an additional pulley 24, or a capture device having a clamping state and a releasing state may then be used to direct all of the cords 18 downward. At each lift point 14 above the bottommost lift points 16, the cords 18 pass freely through loops 26 during lifting. As the lower tiers 28 are drawn upward, the lower lift points 16 and 14 contact the loops 24 on the higher lift points 14, closing the next tiers 28 and drawing the accumulated tiers 28 upward.

It is to be understood that the placement of the pulleys and/or capture device away from the room side of the shade is a design option, and in other embodiments, the hardware may be located on the room side, with the cords 18 directed to the pulleys 20 via grommets in a shade fabric, for example. Other variants may include positioning the cords 18 and the tier lift points 14 and 16 on the room side, using bearing devices without pulleys in place of the pulleys 20, and the like.

Figure 2:
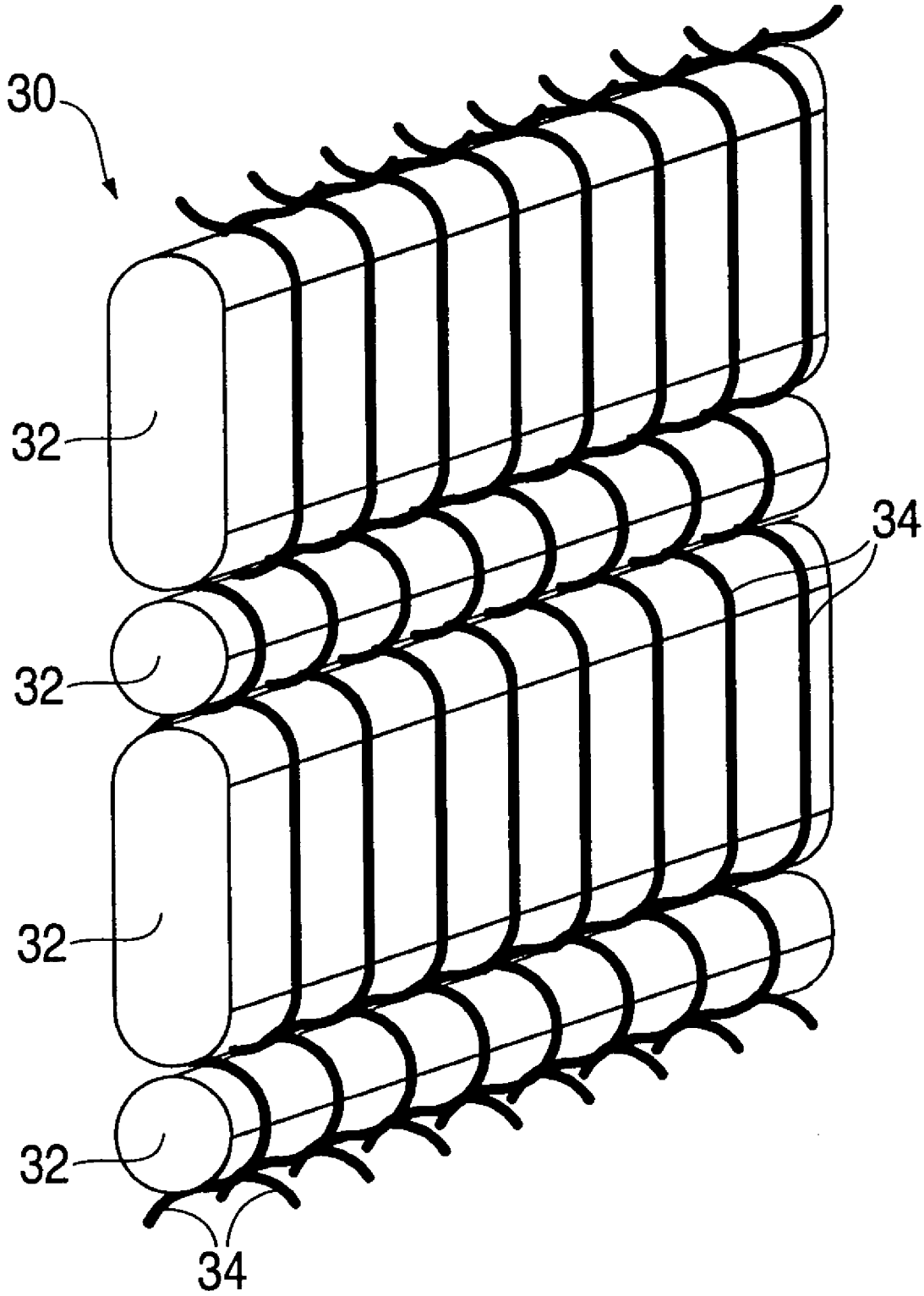
FIG. 2 is an oblique section view of the Roman shade of FIG. 1, showing the structure of the shade fabric.

FIG. 2 is an oblique section view showing a possible structure for a shade fabric 30 for the shade 10 of FIG. 1. Some Roman shades using the construction shown are described as wooden shades, in part to distinguish them from shades wherein the principal window-covering surface is cloth. The figure shows relatively thick and rigid horizontal fibers 32, historically reeds, dowels, strips of bamboo, or splints of various types, optionally uniform or varying in dimensions, and more contemporaneously realized either with such materials or with synthetic, inorganic, or other materials having suitable properties. The figure further shows the weave of relatively thin and flexible vertical-traveling fibers 34, made using cotton, linen, hemp, polypropylene, or other natural or synthetic yarns or threads. The fibers 32 and 34 are so arranged as to allow the fabric 30 of the shade to flex in the direction determined by the flexibility of the vertical fibers 34 and to remain largely nonflexible in the direction determined by the comparatively rigid horizontal fibers 32.

It is to be understood that fabric 30 making up a shade may be configured with material orientations differing from those of the structure shown in FIG. 2. For example, the fibers 32 may be oriented vertically, the surface of the fabric 30 may be oriented horizontally, i.e., parallel to the earth's surface, or another configuration may be used, without diminishing the utility of the invention disclosed herein. Similarly, a rigidity property of fabric fibers as measured on two substantially orthogonal axes may be low and not appreciably different in some embodiments, although battens may be desirable in such embodiments to impose rigidity along one axis. Likewise fiber weave axes may not be substantially orthogonal in some embodiments, and fabric construction may be knitted or otherwise formed rather than woven in some embodiments. In some embodiments, moreover, structure may be established without fibers per se, using instead an articulated material, which may consist of hinged or otherwise interlocking strips, for example, or relatively rigid strakes connected with more flexible structure to form a substantially continuous whole. However, in those configurations wherein there is either one orientation for substantially rigid fibers forming a substantially planar surface, with other materials linking the fibers into a fabric, or a fabric reinforced by parallel battens, it is to be understood that raising a shade formed therefrom retains substantial linearity and parallelism of the battens or substantially rigid fibers, while the linking materials are relatively free to flex.

It is to be further understood that the tiered form taken on by a shade as described herein during raising thereof is not essential to use of the inventive apparatus. For example, in some embodiments, the shade may be rolled, fan-folded, or otherwise gathered while using the inventive apparatus.

Figure 3:
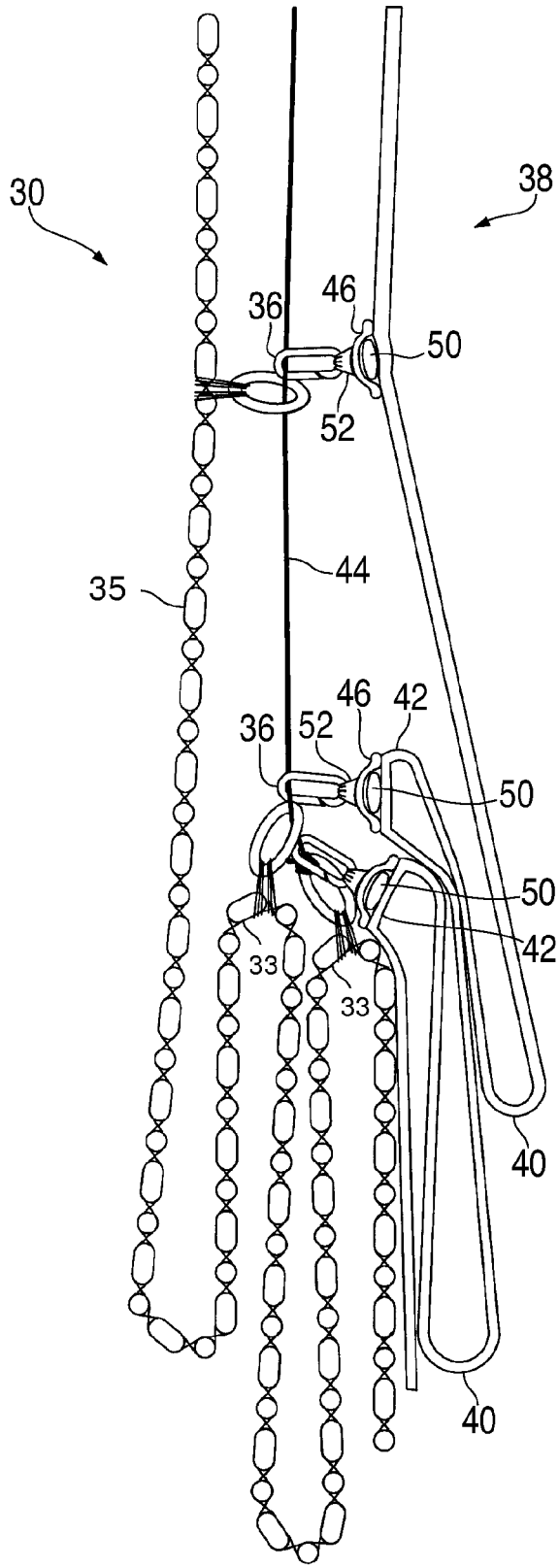
FIG. 3 is a section view of the shade of FIG. 1 including the inventive liner, assuming a partially raised position, showing the liner mirroring the shape of the tiers.

FIG. 3 shows a cross section of the shade of FIG. 1, adapted to incorporate the inventive apparatus, wherein the shade 30 is raised in tiers 33 for a lower portion thereof, with an unraised upper portion 35 hanging substantially straight. As shown, linkage elements 36 join the shade 30 and liner 38, limiting distance between the shade 30 and liner 38 and drawing the liner 38 into folds 40 that form away from the shade 30 as successive liner tiers 42 are established by raising the shade 30. This arrangement allows the lifting cords 44 to draw the shade tiers 32 upward largely free of the tiers 42 formed in the liner 38.

One or more pockets 46 formed in the liner 38 using a material such as a fabric tape attached to the liner 38 by sewing or another method, and oriented parallel to edges of the liner tiers 42 on the shade 30, allow battens 50 to be inserted into the liner 38 to establish more pronounced liner 38 lift points. A second layer of a material such as a fabric tape, sewn or otherwise attached to the batten pockets 46, can provide distributed attachment points 52 for the linkage elements 36. In some embodiments, which may employ a substantially isotropic shade 30 fabric, similar pocket 46 and batten 50 structure may be incorporated into the shade 30 structure.

Figure 4:
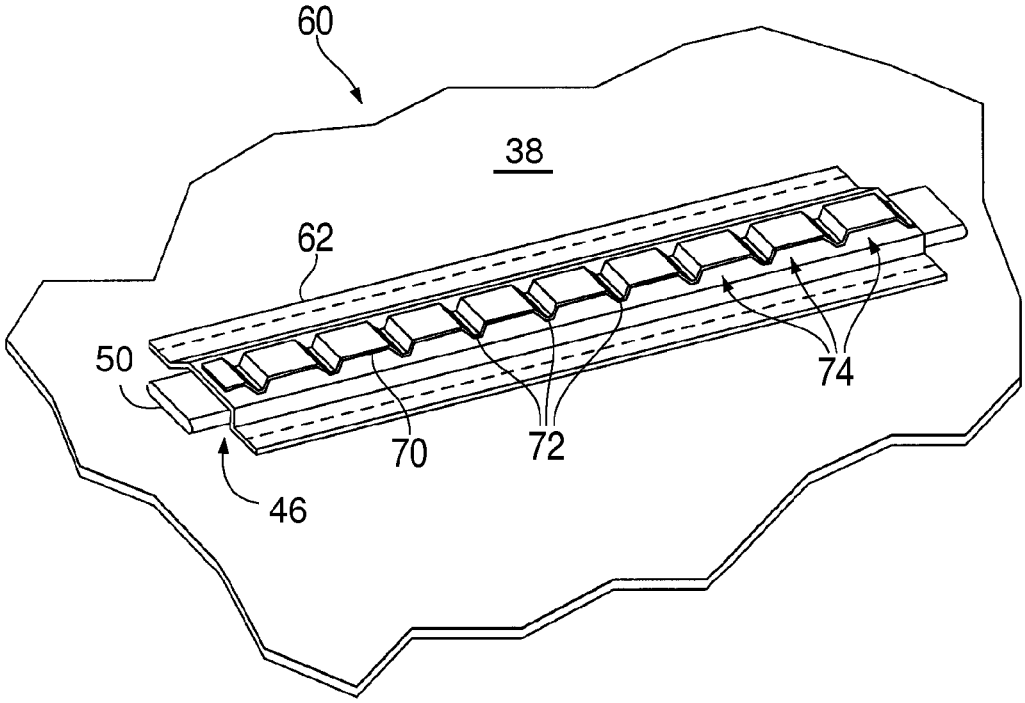
FIG. 4 is a perspective view of a section of a batten pocket according to one embodiment of the invention.

FIG. 4 shows, in oblique section, the batten pocket and attachment point arrangement 60 described above. A first tape 62, forming a pocket 46, holds a batten 50 against the surface of the liner 38. A second tape 70, attached to the first tape 62 at a succession of locations 72 by an attachment method such as sewing, thermal welding, or the like, forms a plurality of transverse loops 74. The loops 74 are configurable to accept fittings such as the linkage elements 36 shown in FIG. 3. It is to be understood that a first tape 62 having a second, preferably narrower tape 70 attached thereto at intervals can be readily produced using methods known in the art. Attachment of the first tape 62 to the liner 38, such as by sewing, without causing the loops 74 to be sewn shut, forms a batten pocket 46 while leaving the row of loops 74 available for a user to position the linkage elements 36 of FIG. 3 as desired.

A plurality of relatively small loops 74, equivalent to the attachment points 52 of FIG. 3, can be distributed substantially continuously over the full width of the liner 38 of FIG. 3 in some embodiments. A location for each linkage element 36 may thus be established that aligns the lifting cord 44, the linkage element 36, and the selected attachment points 52 with small alignment error, minimizing binding as the cord 44 is drawn during raising of the shade. This procedure can provide optimized linkage element 36 placement with respect to lifting cord 44 placement for any sample of Roman shade to which a liner 38 is to be affixed.

In other embodiments, a plurality of eyelet-type holes may be formed in the first tape 62, whereby the distributed loops 74 may be effectively provided without attaching a second tape 70 to the first tape 62.

In still other embodiments, it may be preferred to attach individual loops at discrete locations, to attach loops independent of batten pockets, or to use linkage elements that clip to or pierce the fabric of the batten pocket or the liner, rather than to use the tape-on-tape arrangement described above. Likewise, transparent plastic "safety pin"-shaped linkage elements as shown in the figures may be replaced with self-locking installation ties similar to products used for attaching price tags, promotional literature, and the like to merchandise, or with other styles of linkage elements such as metal rings. In some embodiments, it may be preferred to join the liner to the shade fabric directly, such as by passing an installation tie around one or more slats of the shade and through a batten pocket loop 74 before closing the tie to form a loop, rather than passing the attachment device around the lifting cord 18 of FIG. 1.

Figure 5:
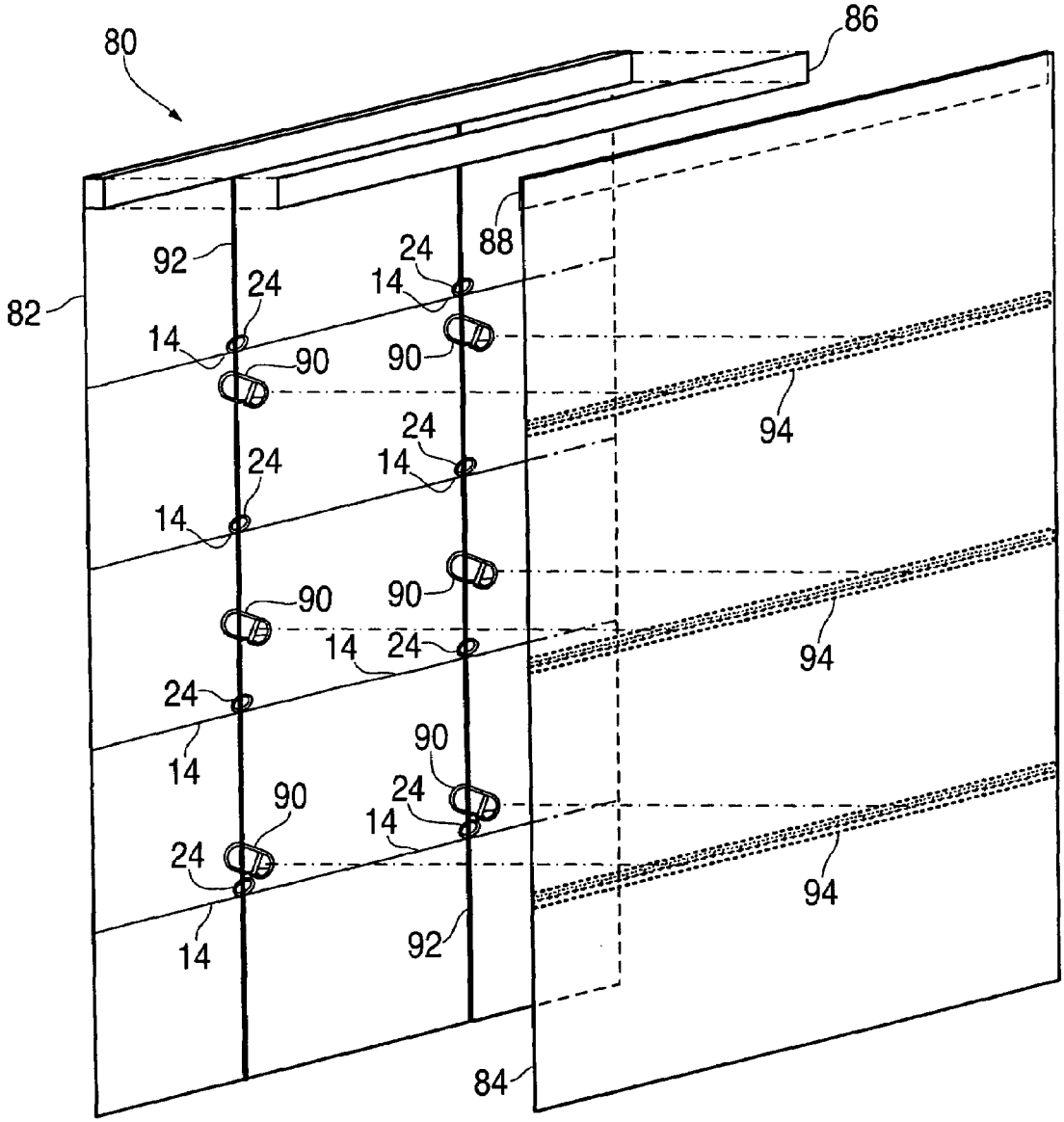
FIG. 5 is an exploded view of a shade and liner, showing the linkages between the shade and liner according to one embodiment of the invention.

FIG. 5 shows, in an exploded diagram 80, a shade 82 and liner 84. Attachment between the shade 82 and liner 84 at the respective tops may use any appropriate method. In the embodiment shown, a mating pair of hook-and-loop fastener tapes 86 and 88, respectively, of which the DuPont® product tradenamed Velcro® is an example, are attached to the respective components 82 and 84. In other embodiments, noncontinuous attachment using multiple segments of hook-and-loop fasteners 86 and 88 or other attachment methods may be preferred.

In some embodiments, the shade 82 and liner 84 may be configured to be joined and separated without sewing or tools. A liner 84, for example, manufactured as a distinct product, and offered separately from a shade 82, may preferably have a first fastener tape 88 manufactured in place on the liner 84, such as by sewing, and may be provided in a universal kit that includes a mating fastener tape 86 to be attached to any available shade 82 of appropriate size. The mating tape 86 may be adhesive backed in some embodiments for ease of attachment to the shade 82. In other embodiments, the mating tape 86 may be an integral component of the shade 82, attached by stapling, plastic welding, sewing, or another attachment process, in anticipation of shade 82 use with a liner 84.

The shade 82 and liner 84 of FIG. 5 are further connected using a plurality of discrete links 90 positioned at intervals over the facing surfaces. The links 90 are clipped around the lifting cords 92 and through loops on the loop tape 94, equivalent to the loop tape 62 of FIG. 4. Tier attachment rings 24 are attached to the shade 82 at the tier lift points 14, as also shown in FIG. 1, and serve to raise the shade 82 when the lifting cords 92 are drawn upward. As the tier attachment rings 24 rise, they contact the next links 90, so that the liner 84 is drawn upward in a succession of tiers mirroring those formed in the shade 82. A liner 84 made from compliant fabric may be urged to form uniform tiers by positioning battens in the loop tapes 94 in desired locations. It may be observed that the numbers of attachment rings 24 and links 90, and thus the number of tiers formed, may not be equal between the shade 82 and liner 84 in this embodiment, but the loose coupling between the two can allow motion to be smooth nonetheless.

Figure 6:
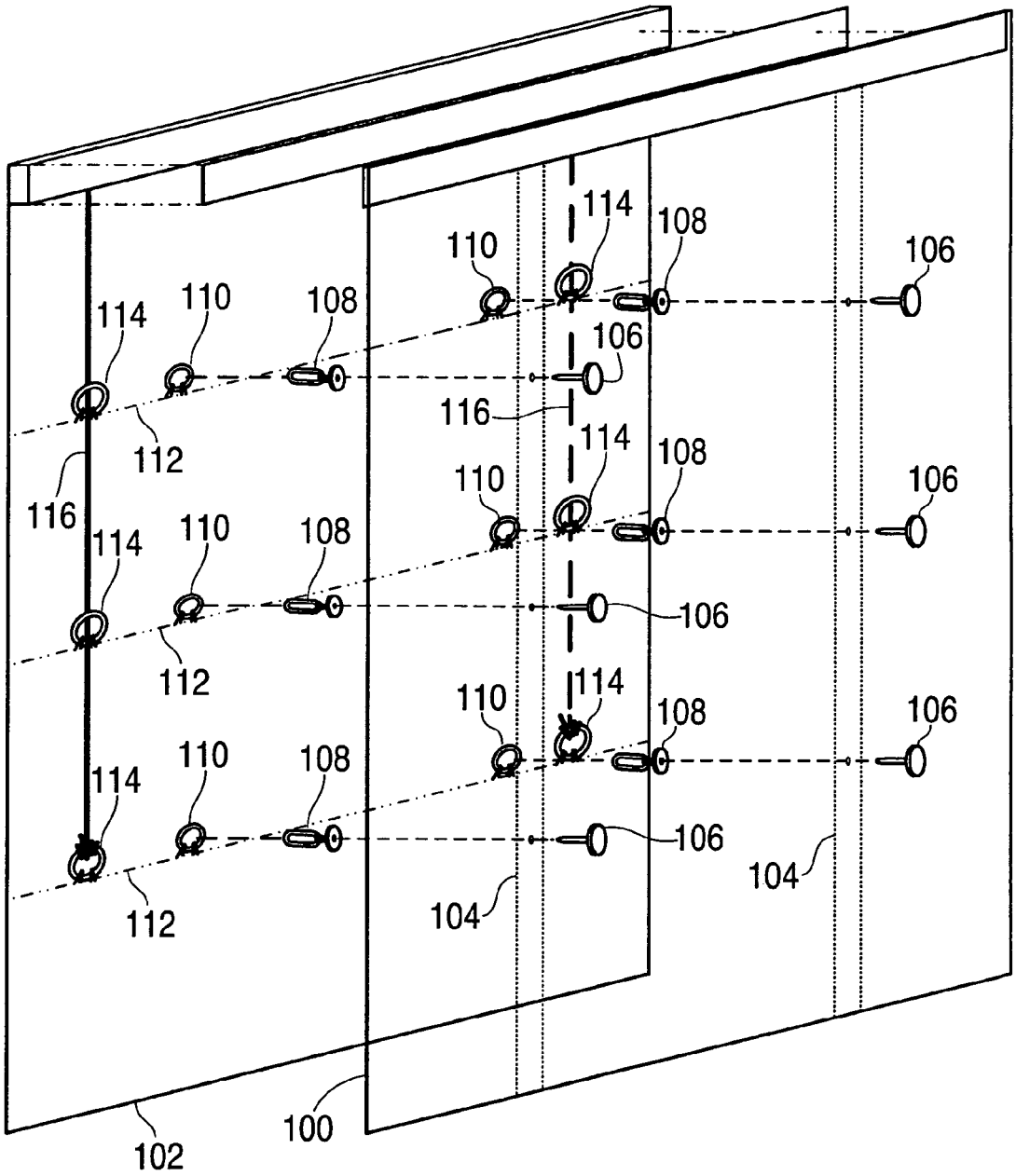
FIG. 6 is an exploded view of a shade and liner, showing the linkages between the shade and liner according to another embodiment of the invention.

FIG. 6 shows an alternative embodiment for attaching a shade liner 100 to a shade 102 according to the inventive apparatus and method. In the embodiment of FIG. 6, vertically-oriented reinforcing tapes 104 are affixed to the liner 100, such as by sewing, and pins 106 lock into clips 108 after passing through the (reinforced) liner 100 fabric. The clips 108 couple to mating rings 110 attached to the shade 102 at locations generally proximal to the tier lift axes 112. The rings 110 in the embodiment shown in FIG. 6 may be, for example, metal or plastic rings similar to tightly spiraled key rings, may be in the form of self-locking installation ties, or may have another configuration according to user preference. In some embodiments, the tier lift loops 114 on the shade 102 may be so positioned with respect to the reinforcing tapes 104 to allow the clips 108 to be clipped directly to the tier lift loops 114, or indeed for the clips 108 to be clipped around the lifting cords 116 as in the embodiment of FIG. 5.

Other embodiments for the clips 108 may use, for example, single-piece designs that clip to or otherwise attach to the liner 100 fabric. In still other embodiments, clips 108 sewn to the liner 100 may be preferable, as may clips 108 that can attach to tape loops integral with the liner 100. As in the case of the clip 108 attached to the shade 102, hook designs may be adaptable to a variety of applications. In some embodiments, the clip 108 and ring 110 may be identical components, each attached by a suitable method to its respective element.

In embodiments using a clip 108 and pin 106, internal structure of a clip 108 receptacle provision to accept the pin 106 may have any preferred shape to provide reasonable ease of assembly, relatively robust resistance to disassembly by pulling apart, and adequate strength for anticipatable wear and tear. A feature such as positive, indissoluble latching of the pin 106, or, in the alternative, tolerance of disassembly and reassembly, may be desirable in some embodiments.

Materials for clips 108 and pins 106 may be chosen according to such criteria as cost and durability. Examples of materials that may be suitable in at least some embodiments include styrene, nylon, and other plastics having attributes of toughness, tolerance to exposure to light, transparency, acceptance of dye colors, low cost, and the like in varying degrees. Other materials may include metal components such as headed steel pins serving as or added to the pin 106 structure.

Numerous other configurations may be preferred in specific embodiments, in consideration of strength, cost of materials and assembly, universality of application, appearance, durability, and the like. It is to be understood that a particular loop 92 design may be adaptable to both isotropic and nonisotropic fabrics, may be suitable for use with shades 102 both with and without specific features to accept liners 100, or may be sufficiently inexpensive to allow inclusion in a liner 100 installation hardware package despite potential nonuse in some applications.

It is to be understood that the shade component and the liner component of the embodiments shown in both FIGS. 5 and 6 occupy respective orientations that are functionally mirrored. That is, the two components of each of the embodiments hang substantially freely from each other below their topmost joining in the embodiments shown when fully extended, forming a first mirrored relationship, with the lifting cords positioned between the components. Further, as the lifting cords draw the shade upward in tiers, the tiers form on the side of the shade away from the lifting cords. Likewise, the liner is drawn upward because of the actions of the lifting cords on the shade, with the liner similarly forming tiers directed to the surface of the liner away from the lifting cords. Thus, the two components move oppositely, and, in retracting at the same rate from the same actuating event, may be characterized as co-retracting.

Figure 7:
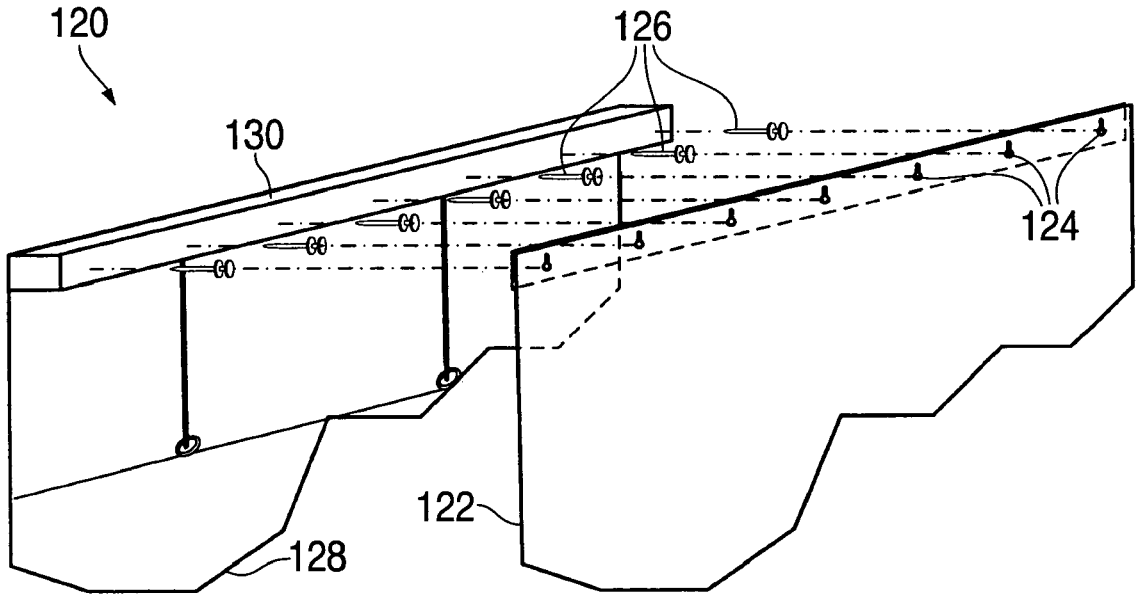
FIG. 7 is an exploded view of an embodiment of the shade and liner having an alternative top attachment configuration.

FIG. 7 shows still another embodiment 120, wherein a top extent of a liner 122 may be fitted with a plurality of prepared capture fittings 124, such as buttonholes, eyelet holes, or loops at intervals along the width of the liner 122, and a kit of duplex-head (also called temporary) nails 126, screws, utility hooks, or the like, whereof protruding portions may serve as buttons or hooks, may be provided for an end user to affix to a shade 128 at the locations of the capture fittings 124. As an example suited to use with hooks in place of the duplex-head nails 126 shown in FIG. 7, a strip of the loop tape 62 of FIG. 4 may be sewn at the top of the liner 122 during manufacture, and cup hooks, picture hooks, adhesive-backed or stapled hooks, or another style of hook readily attached to the head structure 130 of the shade 128, may be furnished for the end user to attach, possibly requiring a basic hand tool for installation.

In embodiments forming the liner tiers at the same heights as the shade tiers, as in FIG. 6, the motion of the components is largely symmetrical, and thus mirrored. In embodiments forming the liner tiers according to a preestablished spacing, as in FIG. 5, the motion of the components is equivalent, but need not be symmetrical, as may be seen, for example, in the unequal number of lift points in the shade and liner of FIG. 5. Because the mechanism raises both components to essentially the same height and forms tiers in both, the term "functionally mirrored" is applicable to the action.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A window shade liner in use with a window shade having a surface, wherein the window shade surface has a first edge, wherein the window shade surface further has a second edge distal to and substantially parallel to the first edge, wherein the second edge is configured to retract and extend between an extended position and a retracted position with respect to the first edge, wherein the window shade has a retraction mechanism configured to apply a retraction motion to the shade, and wherein the window shade liner comprises:

the window shade liner fabric layer substantially coextensive with a window shade, wherein a liner surface faces and is substantially parallel to a shade surface when the shade is in the extended position thereof, said liner fabric layer further comprising, a substantially continuous panel when in said extended position, and at least one tier when in said retracted position, said tier comprising a portion of said panel, folded along a line substantially parallel to said first edge, wherein the line of folding of the tier is retractable toward the first edge;

wherein at least one location on the line of folding is configured as a tier lift location whereby the tier is retracted;

wherein material of the shade surface flexes to accommodate displacement of the material to form tiers;

wherein at least one lift cord is attached to the shade at a location substantially distal to the first edge, and, drawn upward, passes through at least one tier attachment ring attached at a tier lift location;

wherein the at least one tier attachment ring tends to draw upward the tier whereunto the ring is attached when contacted by previously-retracted substance of the shade below the ring during lifting; and a distributed linkage apparatus, wherein the liner and the shade are removably coupled at a plurality of generally proximal locations therebe~een, said distributed linkage apparatus further comprising a plurality of linkage elements, wherein a linkage element is configured to attach to the liner at any of a plurality of locations, wherein the linkage element is further configured to establish a slideable attachment to the lift cord; and a plurality of liner linkage element attachment loops, wherein a linkage element is attachable to at least one attachment loop, said attachment loops further comprising an attachment loop tape positioned on the liner fabric in an orientation substantially parallel to the top edge of the shade; and a plurality of attachments of the attachment loop tape to the liner fabric, wherein the attachments are separated one from the next to form a succession of discrete attachment loops, wherethrough a linkage element may pass in at least one position thereof, wherein the attachment of the tape to the liner fabric is via attachment of the tape to an intermediate tape attached to the liner fabric, and wherein the shade is any tier-lifted shade wherewith the liner is substantially coextensive; and wherein the facing surfaces of the window shade and liner assume functionally mirrored orientations in at least the extended and retracted positions thereof.

2. The window shade liner of claim 1, further comprising a distributed linkage between a region of the shade proximal to the shade first edge and a region of the liner proximal to the shade first edge.

3. The window shade liner of claim 1, wherein the liner tier lift points further comprise battens.

4. The window shade liner of claim 3, wherein the intermediate tape comprises a batten pocket for retaining a batten.

* * * * *

UNITED STATES PATENT AND TRADEMARK OFFICE

CERTIFICATE OF CORRECTION

PATENT NO. : 7,654,299 B2
APPLICATION NO. : 11/208008
DATED : February 2, 2010
INVENTOR(S) : LeBlanc et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 775 days.

Signed and Sealed this

Twenty-third Day of November, 2010

David J. Kappos

David J. Kappos
*Director of the United States Patent and Trademark Office*